US010590519B2

(12) United States Patent
Hosada et al.

(10) Patent No.: US 10,590,519 B2
(45) Date of Patent: Mar. 17, 2020

(54) SUPERELASTIC ALLOY

(71) Applicants: Tanaka Kikinzoku Kogyo K.K., Chiyoda-Ku, Tokyo (JP); Tokyo Institute Of Technology, Meguro-ku, Tokyo (JP)

(72) Inventors: Hideki Hosada, Tokyo (JP); Tomonari Inamura, Tokyo (JP); Masaki Tahara, Tokyo (JP); Tomohiko Morita, Tokyo (JP); Akira Umise, Tokyo (JP); Yusuke Doi, Tokyo (JP); Kenji Goto, Hiratsuka (JP)

(73) Assignees: TANAKA KIKINZOKU KOGYO K.K., Tokyo (JP); TOKYO INSTITUTE OF TECHNOLOGY, Tokyo (JP)

( * ) Notice: Subject to any disclaimer, the term of this patent is extended or adjusted under 35 U.S.C. 154(b) by 660 days.

(21) Appl. No.: 14/913,810

(22) PCT Filed: Aug. 29, 2014

(86) PCT No.: PCT/JP2014/072681
§ 371 (c)(1),
(2) Date: Feb. 23, 2016

(87) PCT Pub. No.: WO2015/030155
PCT Pub. Date: Mar. 5, 2015

(65) Prior Publication Data

US 2016/0362772 A1 Dec. 15, 2016

(30) Foreign Application Priority Data

Aug. 30, 2013 (JP) ..... 2013-178825

(51) Int. Cl.

| | |
|---|---|
| ***C22C 5/02*** | (2006.01) |
| ***C22F 1/14*** | (2006.01) |
| ***B22D 21/00*** | (2006.01) |
| ***C22C 1/02*** | (2006.01) |

(52) U.S. Cl.
CPC ..... *C22F 1/14* (2013.01); *B22D 21/005* (2013.01); *C22C 1/02* (2013.01); *C22C 5/02* (2013.01); *C21D 2201/01* (2013.01)

(58) Field of Classification Search
CPC .... C22F 1/14; C22C 5/02; C22C 1/02; C21D 2201/01; B22D 21/005
See application file for complete search history.

(56) References Cited

U.S. PATENT DOCUMENTS

| | | | | |
|---|---|---|---|---|
| 3,861,455 | A * | 1/1975 | Ingersoll | A61K 6/046 164/122 |
| 7,087,077 | B1 * | 8/2006 | Van Dijk | A61L 27/047 606/108 |
| 2005/0121120 | A1 * | 6/2005 | Van Dijk | A61L 27/047 148/678 |
| 2014/0328718 | A1 * | 11/2014 | Raykhtsaum | C22C 5/02 420/508 |

FOREIGN PATENT DOCUMENTS

| | | | |
|---|---|---|---|
| CN | 1045130 | A | 9/1990 |
| CN | 101565783 | A * | 10/2009 |
| CN | 101565783 | A | 10/2009 |
| DE | 3631830 | A1 | 3/1988 |
| GB | 257891 | A | 8/1927 |
| JP | 55-47361 | A | 4/1980 |
| JP | 8-157984 | A | 6/1996 |
| JP | 2003-293058 | A | 10/2003 |
| JP | 2004-124156 | A | 4/2004 |
| JP | 2005-036273 | A | 2/2005 |
| WO | WO 2008-072485 | A1 | 6/2008 |

OTHER PUBLICATIONS

Espacent machine translation of CN101565783 (Year: 2019).*
EP, Extended Search Report for EP Application No. 14839172.5, dated Mar. 27, 2017.
Fumagalli et al., Thermoelastic Martensitic Transformation in Au—Cu—Al Alloys Doped with Co or Ir, Elsevier Sequoia, Journal of Alloys and Compounds, vol. 433, No. 1-2, pp. 332-337, Mar. 16, 2007.
Gu et al., A2 > B2 > L21 Ordering Transitions in Au—Cu—Al Alloys, Intermetallics, Elsevier Science Publishers B.V., GB, vol. 17, No. 9, pp. 704-707, Sep. 1, 2009.
PCT, International Search Report PCT/JP2014/072681, dated Oct. 7, 2014.
Akira Umise et al. "AuCuAl-ki Keijo Kioku Gokin no Martensite Hentai Kyodo ni Oyobosu Netsu Shori no Eiyko", Abstracts of the Japan Institute of Metals (CD-ROM), vol. 152nd, 13 Mar. 13, 2013, p. Rombunno. 11.
Jin Mingjiang, et al., Internal Friction Analysis of Transformations in AuCuAl Alloy, Shanghai Jiaotong Daxue Xuebao, vol. 44, No. 5, 2010, pp. 609-612.

* cited by examiner

*Primary Examiner* — Colleen P Dunn
*Assistant Examiner* — Anthony M Liang
(74) *Attorney, Agent, or Firm* — Orrick, Herrington & Sutcliffe LLP; Joseph A. Calvaruso; K. Patrick Herman

(57) ABSTRACT

The present invention provides a superelastic alloy formed by addition of Fe or Co to an Au—Cu—Al alloy, including: Cu of 12.5% by mass or more and 16.5% by mass or less; Al of 3.0% by mass or more and 5.5% by mass or less; Fe or Co of 0.01% by mass or more and 2.0% by mass or less; and a balance Au, and a difference between Al content and Cu content (Cu—Al) is 12% by mass or less. The superelastic alloy according to the present invention has superelastic property while being Ni-free, excellent X-ray imaging property, processability, and strength property, and is suitable for a medical field.

5 Claims, No Drawings

SUPERELASTIC ALLOY

TECHNICAL FIELD

The present invention relates to a superelastic alloy and, specifically to a superelastic alloy which can exhibit superelasticity in a normal temperature range while being Ni-free, and is excellent in terms of X-ray imaging property and strength.

BACKGROUND ART

A superelastic alloy has an extremely wide elasticity range when compared to other metal materials at a temperature not lower than a reverse transformation temperature, and has a property of recovering an original shape even when being deformed. The superelastic alloy is expected to be applied to a medical field and medical instruments such as dental braces, a clasp, a catheter, a stent, a bone plate, a coil, a guide wire, and a clip by use of these characteristics.

The superelastic alloy was investigated with respect to various alloy types based on information about a shape-memory alloy. Examples of a superelastic alloy currently best known in terms of practicability include a Ni—Ti-based shape-memory alloy. The Ni—Ti-based shape-memory alloy has a reverse transformation temperature of 100° C. or less, and may exhibit superelasticity at a human body temperature, and thus is considered to be applicable to a medical instrument in terms of characteristic. However, the Ni—Ti-based shape-memory alloy contains Ni which involves concern about biocompatibility due to metal allergy. Biocompatibility is considered to be a fatal problem when application to a medical field is taken into consideration.

In this regard, an alloy material which may exhibit superelastic property while being Ni-free is developed. For example, Patent Document 1 discloses a Ti alloy formed by addition of Mo and one of Al, Ga, and Ge to Ti. In the Ti alloy, Mo is added as an additional element having β-phase stabilizing action of Ti, and Al, Ga, or Ge having excellent biocompatibility are added among additional elements having α-phase stabilizing action. Superelastic property is exhibited by appropriate adjustment of concentrations of the additional elements. Additionally, it is reported that various Ti-based alloys such as a Ti—Nb—Al alloy, and a Ti—Nb—Sn alloy may exhibit superelastic property.

RELATED ART DOCUMENT

Patent Documents

Patent Document 1: JP 2003-293058 A
Patent Document 2: JP 2005-36273 A
Patent Document 3: JP 2004-124156 A

SUMMARY OF THE INVENTION

Problems to be Solved by the Invention

The above-described conventional superelastic material containing the Ti alloy may exhibit superelastic property while Ni is excluded, and thus is expected to be used in a medical field. However, the superelastic material does not satisfy all requirements in the field, and a lot of points need to be improved.

Namely, when the above-described various medical instruments are used, X-ray photography is often required to check installation and usage conditions. For example, in a medical treatment with a stent, surgery is often performed while an instrument moving and reaching a surgical site is verified by use of an X-ray. For this reason, quality of an X-ray imaging property can affect a result of the surgery. In this respect, the superelastic material has an inferior X-ray imaging property.

Additionally, the conventional superelastic material may exhibit superelastic property insufficiently. A medical instrument penetrates into and stays in a human body. Thus, a constituent material of the medical instrument exhibits superelastic property at a human body temperature and the property shall not disappear.

Further, processability and strength are needed to materials applied to various medical instruments. The medical instruments need to be processed in complex shapes, or simple shapes such as extremely thin wires or pipe materials having small diameters. Thus a material which is rarely damaged during a process is required.

The present invention is conceived based on the above-mentioned background, and aims to provide an alloy material which has superelastic property while being Ni-free, excellent X-ray imaging property and processability, and is suitable for use in a medical field.

Means for Solving the Problems

The present inventors proceeded with development based on an Au—Cu—Al alloy in view of material development based on the conventional Ti-based shape-memory alloy to discover a superelastic alloy to solve the above-mentioned problem. The Au—Cu—Al alloy is a material previously known as a shape-memory alloy, and can solve a problem of biocompatibility since Ni is not contained. Additionally, since Au, a heavy metal, is contained, an X-ray imaging property is excellent. Further, the alloy is considered favorable in cost by use of inexpensive Al and Cu rather than relatively high-priced Ti. Therefore, the Au—Cu—Al alloy was considered to be capable of presenting a useful solution to the problem.

The Au—Cu—Al alloy also has problems. Specifically, the alloy does not exhibit superelastic property in a normal temperature range and does not have a characteristic which is most important in application to a medical instrument. Further, the Au—Cu—Al alloy has an inferior point also in processability and there is concern about strength.

Thus the present inventors added suitable additional elements and adjusted a composition range of each constituent element to exhibit a superelastic property and improve processability and strength, with respect to the Au—Cu—Al alloy. As a result of examination, the present inventors found that an Au—Cu—Al—Fe alloy or an Au—Cu—Al—Co alloy having a predetermined composition obtained by addition of Fe or Co as an effective additional element can exhibit a suitable characteristic, and conceived the present invention.

Namely, the present invention is a superelastic alloy formed by addition of Fe or Co to an Au—Cu—Al alloy, including Cu of 12.5% by mass or more and 16.5% by mass or less, Al of 3.0% by mass or more and 5.5% by mass or less, Fe or Co of 0.01% by mass or more and 2.0% by mass or less and a balance Au, a difference between Al content and Cu content (Cu—Al) being 12% by mass or less.

Hereinafter, the present invention will be described in more detail. A superelastic alloy including the Au—Cu—Al—Fe alloy or the Au—Cu—Al—Co alloy according to the present invention is obtained by addition of Cu, Al, and Fe or Co within suitable ranges while Au is used as a primary constituent element. Hereinafter, "%", which indicates an alloy composition, refers to "% by mass".

Cu addition amount is set to 12.5% or more and 16.5% or less. When it is less than 12.5%, superelasticity is not exhibited. When it exceeds 16.5%, a transformation temperature rises, and thus shape memory effect is merely exhibited and superelasticity is not exhibited at a normal temperature. It is more preferably 13.0% or more and 16.0% or less.

Al addition amount is set to 3.0% or more and 5.5% or less. When it is less than 3.0%, the transformation temperature becomes higher, and thus superelasticity is rarely exhibited at the normal temperature. When it exceeds 5.5%, the transformation temperature excessively becomes lower, and processability is degraded. It is more preferably 3.1% or more and 5.0% or less.

Fe and Co are additional elements for improving processability of the alloy. Addition amount of each of Fe and Co is set to 0.01% or more and 2.0% or less. When it is less than 0.01%, there is no effect. On the other hand, when it exceeds 2.0%, a second phase is generated, and exhibition of superelasticity is hindered due to an increase in the second phase. An upper limit is set to 2.0% in consideration of a balance between these effects. Addition amount of each of Fe and Co is more preferably 0.04% or more and 1.3% or less.

A balance is set to Au based on the addition amounts of Cu, Al, Fe, and Co described above. Au concentration is more preferably 78.7% or more and 83.1% or less.

The superelastic alloy including the Au—Cu—Al—Fe alloy according to the present invention contains the respective constituent elements within the above-described ranges. However, a certain restriction needs to be imposed on a relation between Cu and Al contents. While Cu increases a transformation temperature, Al decreases the transformation temperature. When contents of Cu and Al having conflicting functions as described above are set to appropriate ranges, a superelastic phenomenon may be exhibited at a room temperature. Specifically, a difference between Al content and Cu content (Cu—Al) is set to 12.0% or less. A lower limit of the difference between Al content and Cu content is preferably 8.0% or more, and more preferably 9.5% or more.

The superelastic alloy according to the present invention can be manufactured by a common melting and casting method. In this instance, a raw material is preferably melted and cast in a non-oxidizing atmosphere (vacuum atmosphere, inert gas atmosphere, and the like). The alloy manufactured in this manner can exhibit superelasticity in this state.

Note that, after casting, a final heat treatment is preferably performed to heat the cast alloy at a predetermined temperature since superelasticity effect is more effectively exhibited when the final heat treatment is performed. In the final heat treatment, the alloy is preferably heated and retained at a temperature of 300 to 500° C. A heating time is preferably within a range of 5 minutes to 24 hours. The alloy heated for a predetermined time at the temperature is preferably quenched (oil cooling, water cooling, or hot-water cooling).

Alternatively, the cast alloy may be subjected to cold working, and then to the final heat treatment. When cold working is performed before the final heat treatment, a high strength alloy can be obtained. As cold working, either pulling or compressing may be used, and any one of strip processing, wire drawing, extruding, and the like may be adopted. A processing rate is preferably within a range of 5 to 30%.

Advantageous Effects of the Invention

As described above, a superelastic alloy according to the present invention can exhibit superelasticity at a normal temperature while being Ni-free, and has excellent processability.

A superelastic alloy including an Au—Cu—Al—Fe alloy or an Au—Cu—Al—Co according to the present invention has excellent biocompatibility thanks to Ni-free, and excellent X-ray imaging property since Au, a heavy metal, is used as a constituent element. Further, the alloy has excellent processability and strength. Because of the above-described characteristics, the present invention is expected to be applied to medical instruments, such as dental braces, a clasp, an artificial dental root, a clip, a staple, a catheter, a stent, a bone plate, and a guide wire.

DESCRIPTION OF EMBODIMENTS

First Embodiment

Hereinafter, embodiments of the present invention will be described. In the present embodiment, Au—Cu—Al—Fe alloys and Au—Cu—Al—Co alloys having varied concentrations of respective constituent elements were manufactured. After the alloys were processed in specimens, X-ray imaging property was evaluated, and presence or absence of superelastic property within a normal temperature range, processability and strength were measured.

Various superelastic alloys used as samples were manufactured by use of 99.99% pure Cu, 99.99% pure Al, 99.99% pure Au, 99.9% pure Fe, and 99.9% pure Co as melting materials. These raw materials were dissolved in an Ar-1% $H_2$ atmosphere by use of a non-consumable W electrode-type argon arc melting furnace to manufacture an alloy ingot. Thereafter, the alloy ingot was heated at 600° C. for six hours to be homogenized, and then annealed.

Subsequently, a tensile test piece (thickness of 0.2 mm, width of 2 mm×length of 20 mm (length of measurement section of 10 mm)) was manufactured through electrical discharge machining with respect to the alloy ingot (thickness of 1 to 2 mm). After the specimens were processed, the alloys were subjected to a final heat treatment. In the final heat treatment, the alloys were heated at 500° C. for an hour, and then quenched.

With respect to the respective manufactured specimens, X-ray imaging properties were first verified. In this test, the ingot was put between two acrylic plates from upper and lower sides and installed on an X-ray blood vessel photographing apparatus, and X-ray irradiation was conducted under a condition used in an actual X-ray diagnosis (X-ray tube voltage: 60 to 125 kV, X-ray tube current: 400 to 800 mA, irradiation time: 10 to 50 msec, Al filter (2.5 mm) was used). Then, an obtained transmission image was visually observed, and was determined to be "○" when a sample shape was clearly viewed, and "x" when the sample shape was viewed as unclearly as or less clearly than TiNi.

Subsequently, a tensile test (stress loading-unloading test) was conducted on each specimen, and superelastic property was evaluated. In the tensile test for evaluation of superelasticity, a load was applied in the atmosphere (at a room temperature) for $5\times10^{-4}$/sec until elongation of 2% was generated, and then removed. Then, a residual strain was measured to obtain a superelastic shape recovery rate. The superelastic shape recovery rate was obtained by the following Equation.

Superelastic shape recovery rate (%)=(Plastic strain (%) at the time of 2% strain−Residual strain (%))/Plastic strain at the time of 2% strain×100 [Equation 1]

Herein, a value obtained by exclusion of an elastic deformation strain from a total deformation strain is set to a "plastic strain".

Presence or absence of superelasticity was determined to be present ("○") when a calculated superelastic shape recovery rate was 40% or more, and absent ("x") when the rate was less than 40% or a specimen was broken at the time of the tensile test.

Further, a tensile test was conducted on each specimen to evaluate strength and processability. In the tensile test, a load was applied in the atmosphere (at a room temperature) for $5\times10^{-4}$/sec until the specimen was broken. A strain was measured when the specimen was broken to determine that processability was excellent ("○") when a breaking strain of 2% or more was obtained, and poor ("x") when the breaking strain was 2% or less. Additionally, strength was determined to be excellent ("○") for a specimen which has strength exceeding 200 MPa when the specimen was broken, and poor ("x") otherwise. When a specimen was not broken even when a strain of 10% or more from a test condition was applied, the test was ended and a value of 10% was adopted.

Table 1 shows evaluation results with respect to X-ray imaging property, superelastic property, processability, and strength of each specimen.

TABLE 1

| | Alloy composition (% by mass) | | | | | | Evaluation result | | | |
|---|---|---|---|---|---|---|---|---|---|---|
| | Au | Cu | Al | Fe | Co | Cu—Al | Superelasticity | Strength | Processibility | X-ray imaging property |
| Example 1 | 83.1 | 13.2 | 3.7 | 0.04 | — | 9.5 | ○ | ○ | ○ | ○ |
| Example 2 | 82.5 | 13.3 | 3.8 | 0.4 | — | 9.5 | ○ | ○ | ○ | ○ |
| Example 3 | 81.8 | 13.5 | 3.8 | 0.9 | — | 9.7 | ○ | ○ | ○ | ○ |
| Example 4 | 80.4 | 14.7 | 4.0 | 0.9 | — | 10.7 | ○ | ○ | ○ | ○ |
| Example 5 | 81.2 | 14.1 | 3.8 | 0.9 | — | 10.3 | ○ | ○ | ○ | ○ |
| Example 6 | 79.7 | 15.5 | 3.9 | 0.9 | — | 11.6 | ○ | ○ | ○ | ○ |
| Example 7 | 79.2 | 15.7 | 4.2 | 0.9 | — | 11.5 | ○ | ○ | ○ | ○ |
| Example 8 | 78.7 | 15.9 | 4.5 | 0.9 | — | 11.4 | ○ | ○ | ○ | ○ |
| Example 9 | 79.2 | 14.9 | 5.0 | 0.9 | — | 9.9 | ○ | ○ | ○ | ○ |
| Example 10 | 80.5 | 15.0 | 3.2 | 1.3 | — | 11.8 | ○ | ○ | ○ | ○ |
| Example 11 | 81.9 | 13.4 | 3.8 | — | 0.9 | 9.6 | ○ | ○ | ○ | ○ |
| Example 12 | 81.8 | 13.5 | 3.8 | 0.5 | 0.4 | 9.7 | ○ | ○ | ○ | ○ |
| Comparative Example 1 | 77.4 | 16.7 | 5.9 | — | — | 10.8 | x | x | x | ○ |
| Comparative Example 2 | 77.9 | 17.6 | 4.5 | — | — | 13.1 | x | x | ○ | ○ |
| Comparative Example 3 | 79.0 | 17.8 | 3.2 | — | — | 14.6 | x | x | x | ○ |
| Comparative Example 4 | 80.1 | 15.5 | 4.4 | — | — | 11.1 | x | x | x | ○ |
| Comparative Example 5 | 81.1 | 15.1 | 3.8 | — | — | 11.3 | x | x | x | ○ |
| Comparative Example 6 | 81.3 | 15.3 | 3.4 | — | — | 11.9 | x | x | x | ○ |
| Comparative Example 7 | 81.8 | 15.1 | 3.1 | — | — | 12.0 | x | ○ | ○ | ○ |
| Comparative Example 8 | 82.0 | 14.7 | 3.3 | — | — | 11.4 | x | ○ | ○ | ○ |
| Comparative Example 9 | 82.4 | 14.5 | 3.1 | — | — | 11.4 | x | x | ○ | ○ |
| Comparative Example 10 | 82.9 | 14.3 | 2.8 | — | — | 11.5 | x | ○ | ○ | ○ |
| Comparative Example 11 | 82.9 | 12.9 | 4.2 | — | — | 8.7 | x | x | ○ | ○ |
| Comparative Example 12 | 83.2 | 12.2 | 3.7 | 0.9 | — | 8.5 | x | ○ | ○ | ○ |
| Comparative Example 13 | 80.0 | 15.7 | 3.4 | 0.9 | — | 12.3 | x | ○ | ○ | ○ |
| Comparative Example 14 | 79.9 | 13.4 | 5.8 | 0.9 | — | 7.6 | x | ○ | ○ | ○ |
| Comparative Example 15 | 75.9 | 17.1 | 6.0 | 1.0 | — | 11.1 | x | ○ | ○ | ○ |
| Comparative Example 16 | 79.9 | 13.9 | 3.9 | 2.3 | — | 10.0 | x | ○ | ○ | ○ |

Table 1 shows that Examples 1 to 11, in which content of each constituent element is within an appropriate range, exhibited superelasticity and had excellent processability and strength. On the other hand, an Au—Cu—Al alloy to which Fe and Co were not added (Comparative Examples 1 to 11) did not exhibit superelasticity and had poor processability or strength in many cases. Additionally, even when Fe was added, if Cu and Al contents were inappropriate (Comparative Examples 12, and 14 to 16), superelasticity was not exhibited even though processability or strength was excellent. Further, it is shown that superelasticity was not exhibited when a difference between Cu and Al contents was inappropriate (Comparative Example 13). From above, in an Au—Cu—Al—Fe (Co) alloy, an excellent characteristic such as exhibition of superelasticity, and importance of composition adjustment for the excellent characteristic are verified.

Second Embodiment

Herein, influences of a final heat treatment temperature and cold working on alloy characteristics were examined with respect to an alloy of Example 3 of the first embodiment (81.8% Au–13.5% Cu–3.8% Al–0.9% Fe).

First, in order to examine an influence of the final heat treatment temperature, a heat treatment temperature was changed (100° C. (Reference Example 1), 200° C. (Reference Example 2), 300° C. (Example 13), 400° C. (Example 14), 600° C. (Reference Example 3)) after a tensile test piece was manufactured in a process of manufacturing a specimen of the first embodiment, and the final heat treatment for conducting quenching after the heat treatment was performed. Additionally, herein, characteristic of melted and cast alloy which is not subjected to the final heat treatment was evaluated (Example 15). This alloy was obtained by manufacture of a tensile test sample by wire discharge with respect to a melted and cast alloy ingot. Then, presence or absence of superelastic property, processability, and strength were measured on these specimens similarly to the first embodiment. Measurement results are shown in Table 2.

TABLE 2

| | Final heat treatment temperature | Super-elasticity | Strength | Processibility |
|---|---|---|---|---|
| Reference Example 1 | 100° C. | x | ○ (500 MPa) | ○ Elongation 3.8% |
| Reference Example 2 | 200° C. | x | ○ (700 MPa) | ○ Elongation 5.8% |
| Example 13 | 300° C. | ○ | ○ (690 MPa) | ○ Elongation 6.3% |
| Example 14 | 400° C. | ○ | ○ (750 MPa) | ○ Elongation 6.0% |
| Example 3 | 500° C. | ○ | ○ (700 MPa) | ○ Elongation 6.2% |
| Example 15 | — | ○ | ○ (350 MPa) | ○ Elongation 2.4% |
| Reference Example 3 | 600° C. | x | x (100 MPa) | x Elongation 0.8% |

Table 2 shows that a final heat treatment temperature mainly affects superelastic property, and superelastic property is excellent in a final heat treatment at 300 to 500° C. Additionally, when the final heat treatment temperature is excessively high (600° C.), superelastic property is not exhibited, and the temperature has a bad influence on strength and processability. As a result, a necessity for a final heat treatment within a suitable temperature range was confirmed.

Additionally, a result of Example 15 shows that the final heat treatment is not an essential treatment in terms of exhibiting superelasticity and ensuring strength.

Next, an influence of cold working before a final heat treatment was examined. With regard to the process of manufacturing the specimen of the first embodiment, an alloy ingot was heated at 500° C. for 1 hour, and then cold-rolled up to 0.2 mm (processing rate of 24%). Thereafter, a tensile test piece was processed and manufactured. Then, a final heat treatment for conducting quenching after the heat treatment was performed by setting of a treatment temperature to 300° C., 400° C., and 500° C., and presence or absence of superelastic property, processability, and strength were measured similarly to the first embodiment. Measurement results are shown in Table 3.

TABLE 3

| Final heat treatment temperature | Cold working | Super-elasticity | Strength | Processibility |
|---|---|---|---|---|
| 300° C. | Present | ○ | ○ (800 MPa) | (Elongation 8.0%) |
| | Absent (Example 13) | ○ | ○ (690 MPa) | (Elongation 6.3%) |
| 400° C. | Present | ○ | ○ (800 MPa) | (Elongation 6.0%) |
| | Absent (Example 13) | ○ | ○ (750 MPa) | (Elongation 6.0%) |
| 500° C. | Present | ○ | ○ (750 MPa) | (Elongation 6.2%) |
| | Absent (Example 13) | ○ | ○ (700 MPa) | (Elongation 6.2%) |

Table 3 shows that cold working performed before a final heat treatment can improve strength and processability of an alloy after the final heat treatment rather than exerting a bad influence on superelastic property. In this regard, even though an alloy according to the present invention has relatively high strength even when cold working is not performed, the strength is preferably ensured by cold working when the alloy is provided for use which requires higher strength.

INDUSTRIAL APPLICABILITY

An elastic alloy according to the present invention does not contain Ni to have biocompatibility, and contains Au to have excellent X-ray imaging property. Furthermore, the elastic alloy can exhibit superelasticity at a normal temperature, and can be expected to be applied to various medical instruments.

The invention claimed is:

1. A superelastic alloy formed by addition of Fe to an Au—Cu—Al alloy, wherein the superelastic alloy comprises:

Cu of 12.5% by mass or more and 16.5% by mass or less;

Al of 3.1% by mass or more and 5.5% by mass or less;

Fe of 0.9% by mass or more and 2.0% by mass or less;

a balance of Au, and further wherein a difference between the Al content and the Cu content (Cu—Al) is 12% by mass or less: and wherein the superelastic alloy has a superelastic shape recovery rate of 40% or more calculated by a following equation based on a plastic strain at the time of 2% strain measured when the superelastic alloy is subjected to a tensile test and an unloaded residual strain:

Superelastic shape recovery rate (%)=(plastic strain (%) at the time of 2% strain−residual strain (%))/plastic strain at the time of 2% strain×100 [Equation 1]

wherein plastic strain is a value obtained by exclusion of an elastic deformation strain from a total deformation strain.

2. The superelastic alloy according to claim 1, wherein the Au content is 78.7% by mass or more and 83.1% by mass or less.

3. A method of manufacturing the superelastic alloy according to claim 1, comprising the steps of:

melting and casting an alloy including

Cu of 12.5% by mass or more and 16.5% by mass or less,

Al of 3.1% by mass or more and 5.5% by mass or less,

Fe of 0.9% by mass or more and 2.0% by mass or less, and a balance of Au; and performing a final heat treatment of heating and maintaining the alloy at 300 to 500° C. and then quenching the alloy.

4. The method of manufacturing the superelastic alloy according to claim 3, comprising the step of cold working the alloy before the step of the final heat treatment.

5. A method of manufacturing the superelastic alloy according to claim 2, comprising the steps of:

melting and casting an alloy including

Cu of 12.5% by mass or more and 16.5% by mass or less,

Al of 3.1% by mass or more and 5.5% by mass or less,

Fe of 0.9% by mass or more and 2.0% by mass or less, and a balance of Au, wherein the Au content is 78.7% by mass or more and 83.1% by mass or less; and performing a final heat treatment of heating and maintaining the alloy at 300 to 500° C. and then quenching the alloy.

* * * * *